US009096360B2

(12) United States Patent
Rajter, Jr.

(10) Patent No.: US 9,096,360 B2
(45) Date of Patent: Aug. 4, 2015

(54) MERCHANDISE CONTAINER WITH INTEGRATED HANG TAB

(71) Applicant: Wynalda Litho, Inc., Belmont, MI (US)

(72) Inventor: Robert G. Rajter, Jr., Rockford, MI (US)

(73) Assignee: Wynalda Litho, Inc., Belmont, MI (US)

( * ) Notice: Subject to any disclaimer, the term of this patent is extended or adjusted under 35 U.S.C. 154(b) by 0 days.

(21) Appl. No.: 14/265,150

(22) Filed: Apr. 29, 2014

(65) Prior Publication Data

US 2014/0319154 A1 Oct. 30, 2014

Related U.S. Application Data

(60) Provisional application No. 61/817,389, filed on Apr. 30, 2013.

(51) Int. Cl.
*B65D 75/56* (2006.01)

(52) U.S. Cl.
CPC ..... *B65D 75/56* (2013.01)

(58) Field of Classification Search
CPC ..... B65D 75/56; B65D 1/10; B65D 5/4208
USPC ..... 206/1.5, 806; 220/628; 229/155, 117.12
See application file for complete search history.

(56) References Cited

U.S. PATENT DOCUMENTS

| | | | | | |
|---|---|---|---|---|---|
| 2,964,227 | A * | 12/1960 | Goldsholl | 229/128 |
| 3,010,571 | A * | 11/1961 | Transport | 206/758 |
| 3,695,508 | A * | 10/1972 | Hocking | 229/101 |
| 3,814,303 | A * | 6/1974 | Smith | 229/117.18 |
| 3,929,222 | A * | 12/1975 | Smith et al. | 206/783 |
| 4,210,240 | A * | 7/1980 | Fricano | 206/777 |
| 5,284,294 | A * | 2/1994 | Floyd | 229/179 |
| 5,896,996 | A * | 4/1999 | Chuang | 206/769 |
| 5,911,358 | A * | 6/1999 | Kenner et al. | 229/116.1 |
| 5,924,626 | A * | 7/1999 | Whitnell | 229/128 |
| 6,152,359 | A * | 11/2000 | Clark | 229/117.04 |
| 6,672,762 | B1 * | 1/2004 | Faircloth et al. | 383/9 |
| 6,719,128 | B2 * | 4/2004 | Alpern et al. | 206/63.3 |
| 7,178,712 | B2 * | 2/2007 | Schultz et al. | 229/102 |
| 7,451,909 | B2 * | 11/2008 | Sexton | 229/92.8 |
| D614,022 | S * | 4/2010 | Melnick | D9/415 |
| D640,549 | S * | 6/2011 | Atkin et al. | D9/431 |
| 2008/0073246 | A1 * | 3/2008 | Herring et al. | 206/776 |
| 2014/0138262 | A1 * | 5/2014 | Rajter, Jr. | 206/1.5 |

* cited by examiner

*Primary Examiner* — Steven A. Reynolds
(74) *Attorney, Agent, or Firm* — Zollinger & Burleson Ltd.

(57) ABSTRACT

A merchandise storage container includes an integrated hang tab. The hang tab is connected to the outer end panel that defines a portion of the lid of the container so that the hang tab may be use to help open the container when the user has removed the container from a display hook. The hang tab can be formed from only a single layer of material. A locking tab latches into a slot defined between an inner end panel and a rear wall of the container. The hang tab includes spaced legs disposed on either side of the locking tab. This configuration of the hang tab evenly distributes the hanging forces on either side of the locking tab.

16 Claims, 3 Drawing Sheets

MERCHANDISE CONTAINER WITH INTEGRATED HANG TAB

CROSS REFERENCE TO RELATED APPLICATIONS

This application claims the benefit of U.S. Provisional Patent Application Ser. No. 61/817,389 filed Apr. 30, 2013; the disclosures of which are incorporated herein by reference.

BACKGROUND INFORMATION

1. Technical Field

The disclosure generally relates to merchandise storage containers and, more particularly, to merchandise storage containers hung from a hook that extends through an opening defined by a portion of the merchandise storage container. Specifically, the disclosure relates to foldable-material merchandise storage containers that have integral hanger openings.

2. Background Information

Different items of merchandise are often displayed at retail locations in a hanging configuration from a hook. One common configuration is for a plurality of the same items of merchandise to be hung from a common elongated hook. The elongated hook is disposed through an opening defined by a portion of the merchandise storage container. These openings are aligned when a plurality of the same items are disposed on a common hook. In some configurations of merchandise storage containers, the opening that receives the hook is defined by the body of the container where the merchandise is carried. Such containers have the drawback of potential merchandise damage when the containers are placed onto the hooks and repeatedly removed from and replaced back onto the hooks when potential customers browse the merchandise. Other merchandise storage containers require a hang tab to be added to the container so that the container may be displayed on a hook. This occurs when a retail merchant wishes to display merchandise disposed in containers without hook openings. These hang tabs may be adhesively connected or secured with staples. Eventually, the adhesive or staple fails and the merchandise container falls to the floor to the rack below leaving an unattractive display and clean up work for the merchant.

SUMMARY OF THE DISCLOSURE

A merchandise storage container includes an integrated hang tab. The hang tab is connected to the outer end panel that defines a portion of the lid of the container so that the hang tab may be use to help open the container when the user has removed the container from a display hook.

In one configuration, the hang tab is formed from only a single layer of material.

In one configuration, the hang tab opening is formed by folding a locking tab out of the hang tab body.

In one configuration, the integrated hang tab defines an opening for a display hook wherein a portion of the opening is defined by a portion of the body of the merchandise display container.

A merchandise storage container includes a lid that has a locking tab that latches into a slot defined between an inner lid flap and a rear wall of the merchandise storage container. A hang tab integrally extends from the lid and defines an opening used to hang the container on a display hook. The hang tab includes spaced legs disposed on either side of the locking tab. This configuration of the hang tab evenly distributes the hanging forces on either side of the locking tab.

The disclosure provides a merchandise container having an integrated hang tab that extends from the rear edge of the outer lid panel so that no opening is defined by the outer lid panel when the hang tab is erected for use.

Integrally forming the hang tab with the lid of the storage container eliminates the need for adding an adhesive hang tab when the merchandise is displayed from a hook.

One configuration of the merchandise display container is a pillow pack wherein the hang tab is integrally formed with the lid panel of the container.

The individual features described herein may be combined into different combinations to define additional configurations of the merchandise storage container of the disclosure.

BRIEF DESCRIPTION OF THE DRAWINGS

Similar numbers refer to similar parts throughout the specification.

DETAILED DESCRIPTION OF THE DISCLOSURE

Figure 1:
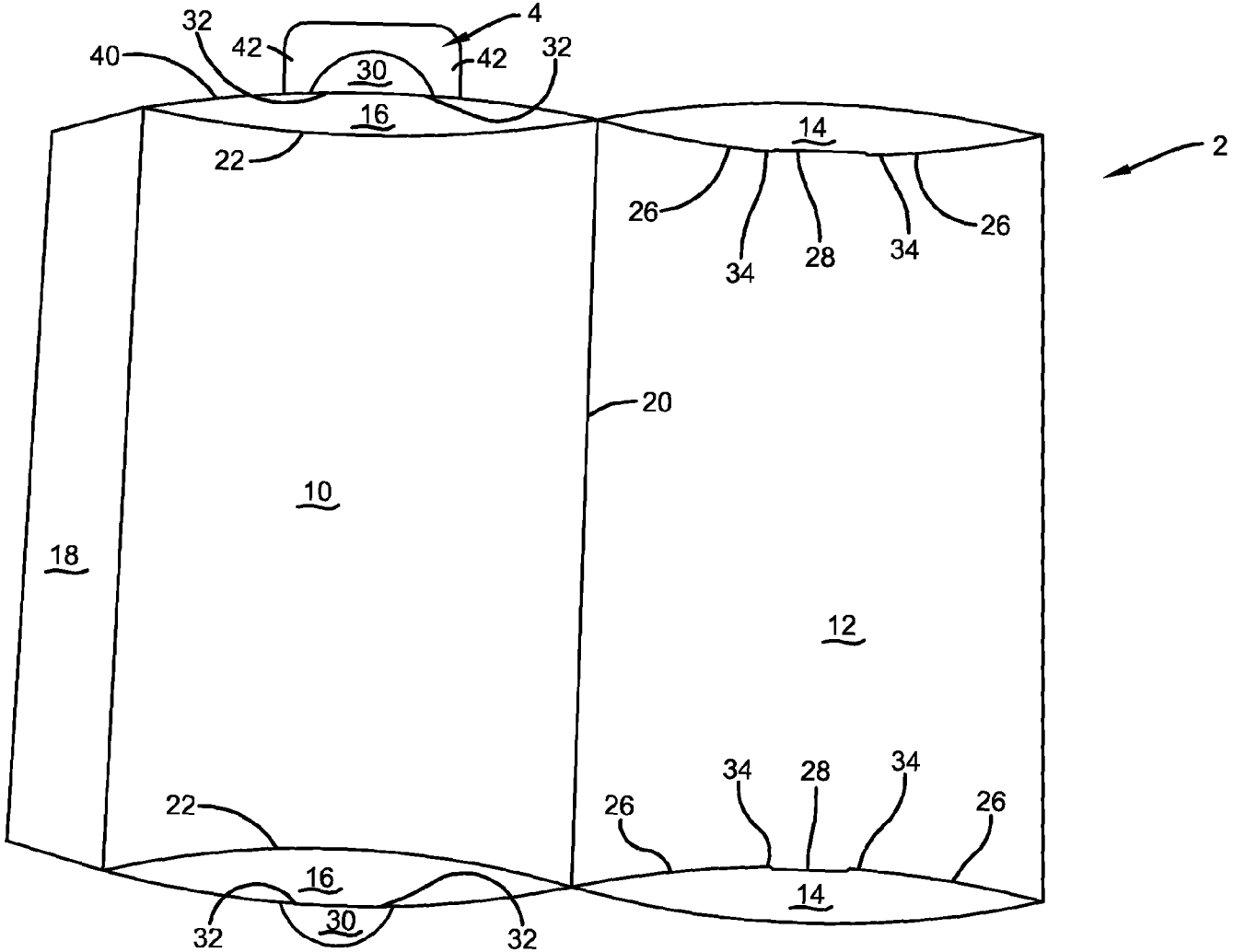
FIG. 1 is a plan view of a blank used to form the merchandise storage container of the disclosure.
Figure 2:
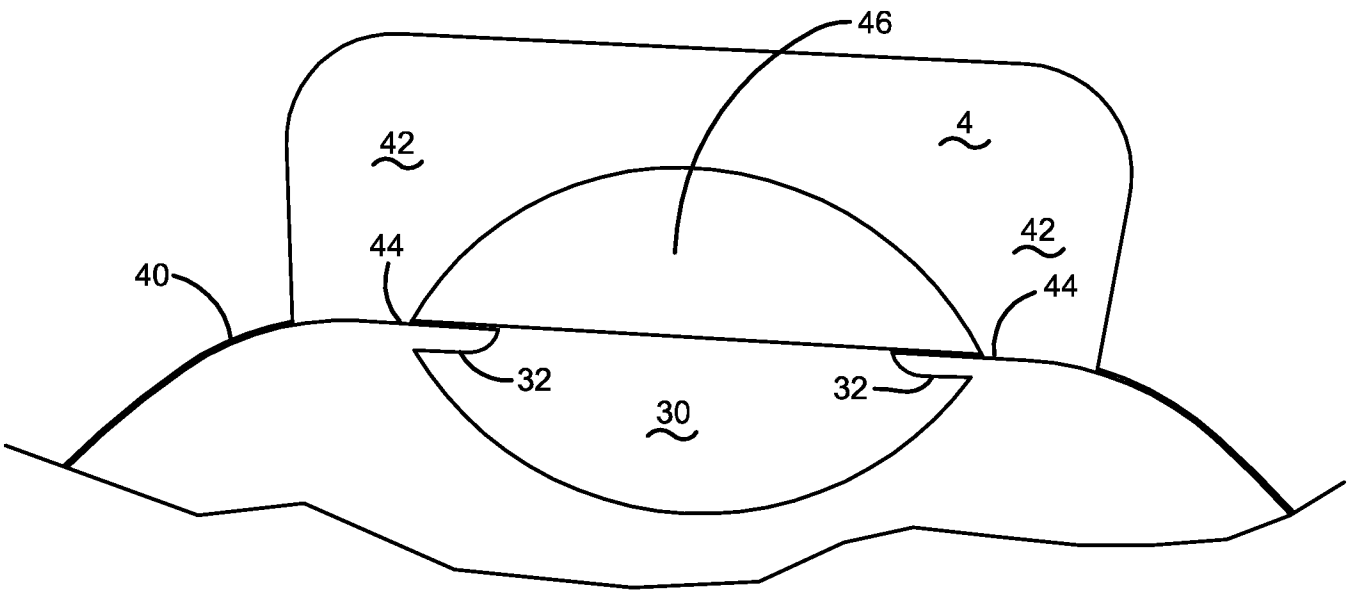
FIG. 2 is a view of the hang tab and locking tab before the lid is closed.
Figure 3:
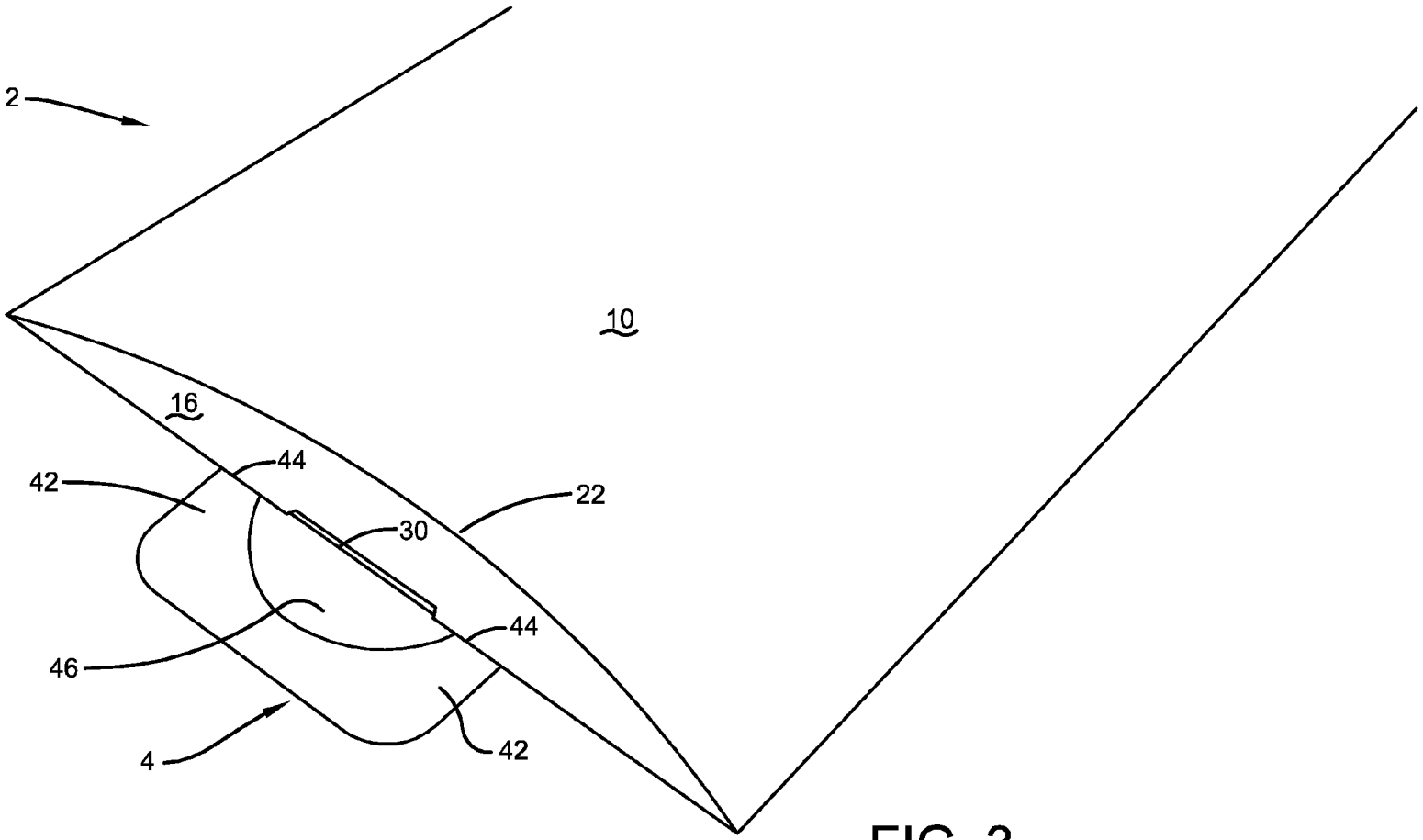
FIG. 3 is a perspective view of the hang tab with the lid closed.

An exemplary configuration of a merchandise storage container is indicated generally by the numeral 2 in the accompany drawings. Although the exemplary configuration of the container is a pillow pack, the integrated hang tab 4 described below may be used with a variety of folded storage container configurations. These containers are fabricated from a material that is foldable such as a paperboard or a thin polymer such as thin foldable PVC.

The exemplary configuration of container 2 includes a front panel 10, a rear panel 12, and inner 14 and outer 16 end panels (also referred to as bottom panels and lid panels). A glue tab 18 is used to form these panels into a tube. Other configurations of container 2 include side panels to form a rectangular box-shaped container.

In the exemplary configuration, container 2 is a pillow package-type storage container wherein front panel 10 and rear panel 12 are bowed outwardly with end panels 14 and 16 having curved edges and each is shaped as a vesica piscis. Front panel 10 is connected to rear panel 12 at a first fold 20 which is formed along a straight edge of panel 10 that may be defined by a score when the blank for container 2 is formed from the foldable material. The upper and lower edges of front panel 10 are curved and are connected to outer end panels 16 at second folds 22 which also may be defined by scores. A third fold connects the straight edge of front panel 10 opposite first fold 20 to glue tab 18. The upper and lower edges of rear panel 12 are curved and are connected to inner end panels 14 at fourth folds 26 which also may be defined by scores. Fourth folds 26 are divided into two spaced sections by an offset locking slot 28. Each offset locking slot 28 is configured to receive a locking tab 30 when outer end panel 16 is closed over inner end panel 14. Each locking tab 30 includes lateral locking shoulders 32 that are received in the end portions 34 of offset locking slot 28 that are aligned with folds 26 while the main body of locking tab 30 is received in the middle offset portion of offset locking slot 28 which is spaced into the body of inner end panel 14.

Hang tab 4 extends from the outer edge 40 of one of outer end panels 16 and is integrally formed with outer end panel 16. Hang tab 4 includes a pair of spaced legs 42 that are connected to outer panel 16 at folds 44 on both sides of locking tab 30. Legs 42 distribute forces of hang tab 4 to outer end panel 16 on both sides of locking tab 30. The connection of hang tab 4 to outer end panel 16 allows the user to grasp hang tab 4 and use it as a handle to open outer panel 16. Pulling on hang tab 4 pulls locking tab 30 from slot 28 and eliminates the need for the user to pry locking tab 30 from slot 28 with a finger tip, finger nail, or tool.

Hang tab 4 cooperates with outer panel 16 and/or locking tab 30 to define a hanger opening 46. In other configurations, hanger opening 46 may be entirely defined by hang tab 4 or may be configured as a slot extending into hang tab 4 from the top or side edge of hang tab 4. As shown in FIG. 1, hang tab 4, locking tab 30, and outer panel 16 are formed together in a flat configuration. When container 2 is assembled, outer end panel 16 is substantially perpendicular to hang tab 4 and locking tab 30 with hang tab 4 folded up and locking tab 30 being folded down.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A merchandise storage and display container comprising:

a container body including a front panel, a rear panel, an inner end panel connected to one of the front and rear panels, and an outer end panel connected to the other of the front and rear panels;

a hang tab integrally extending from the outer end panel; the hang tab defining a hanger opening adapted to receive a portion of a hook to allow the container body to be supported by the hang tab;

the outer end panel being selectively movable between open and closed conditions;

a locking tab extending from and moving with the outer end panel between the open and closed positions;

when the outer end panel is in the closed condition, the locking tab extending through a portion of and engaging a portion of the inner end panel to hold the outer end panel in the closed position;

wherein the hang tab is connected to the outer end panel with first and second spaced legs;

wherein the locking tab is connected to the outer end panel between the first and second spaced legs; and the first and second spaced legs and the locking tab are connected to an outer edge of the outer end panel; the outer edge positioning the locking tab against the one of the front and rear panels connected to the inner end panel.

2. A merchandise storage and display container comprising:

a container body including a front panel, a rear panel, an inner end panel connected to one of the front and rear panels, and an outer end panel connected to the other of the front and rear panels;

a hang tab integrally extending from the outer end panel; the hang tab defining a hanger opening adapted to receive a portion of a hook to allow the container body to be supported by the hang tab;

the outer end panel being selectively movable between open and closed conditions;

a locking tab extending from and moving with the outer end panel between the open and closed positions;

when the outer end panel is in the closed condition, the locking tab extending through a portion of and engaging a portion of the inner end panel to hold the outer end panel in the closed position; and the locking tab including a pair of lateral locking shoulders that engage the inner end panel when the outer end panel is in the closed position.

3. The container of claim 2, wherein the hang tab extends from an edge of the outer end panel and the locking tab extends from the same edge of the outer end panel as the hang tab; the locking tab and hang tab projecting away from each other.

4. The container of claim 3, wherein the container body is fabricated from a foldable material and the hang tab and outer end panel are defined by only a single layer of the foldable material.

5. The container of claim 4, wherein the hang tab is connected to the outer end panel with first and second spaced legs.

6. The container of claim 5, wherein the locking tab is connected to the outer end panel between the first and second spaced legs.

7. A merchandise storage and display container comprising:

a container body including a front panel, a rear panel, an inner end panel connected to one of the front and rear panels, and an outer end panel connected to the other of the front and rear panels;

a hang tab integrally extending from the outer end panel; the hang tab defining a hanger opening adapted to receive a portion of a hook to allow the container body to be supported by the hang tab;

wherein the hang tab is connected to the outer end panel with first and second spaced legs;

wherein the outer end panel is selectively movable between open and closed conditions and wherein the container body further comprises a locking tab extending from the outer end panel; the locking tab engaging the inner end panel to hold the outer end panel in the closed position;

wherein the locking tab is connected to the outer end panel between the first and second spaced legs;

wherein the locking tab includes a pair of lateral locking shoulders that engage the inner end panel when the outer end panel is in the closed position; and wherein the inner end panel defines an offset locking slot and wherein the offset locking slot includes end portions aligned with a fold line that defines the connection between the inner end panel and the one of front and rear panels; the end portions sized to receive the lateral locking shoulders of the locking tab.

8. The container of claim 7, wherein the outer end panel is in the shape of a vesica piscis.

9. The container of claim 8, wherein the front and rear panels are bowed outwardly to define a pillow pack.

10. The container of claim 9, wherein the front panel is directly connected to the rear panel at a fold line.

11. The container of claim 10, further comprising a glue tab extending from one of the front and rear panels; the glue tab being connected to the other of the front and rear panels to connect the front and rear panels together.

12. A merchandise storage and display container comprising:

a container body including a front panel, a rear panel, an inner end panel connected to one of the front and rear panels, and an outer end panel connected to the other of the front and rear panels;

the outer end panel defining an outer perimeter edge spaced from the connection between the outer end panel and the one of the front and rear panels;

a hang tab integrally extending from the outer perimeter edge of the outer end panel; the hang tab defining a hanger opening adapted to receive a portion of a hook to allow the container body to be supported by the hang tab;

the hang tab including first and second spaced legs that are connected to the outer perimeter edge of the outer end panel; the first and second spaced legs being spaced by the hanger opening of the hang tab; the hanger opening extending to the outer perimeter edge of the outer end panel;

a locking tab extending from the same outer perimeter edge of the outer end panel as the hang tab; the outer perimeter edge positioning the locking tab against the one of the front and rear panels connected to the inner end panel; the locking tab engaging the inner end panel to hold the outer end panel in a closed position;

wherein the locking tab is connected to the outer end panel between the first and second spaced legs; and wherein the locking tab includes a pair of lateral locking shoulders that engage the inner end panel when the outer end panel is in the closed position.

13. A merchandise storage and display container comprising:

a container body including a front panel, a rear panel, an inner end panel connected to one of the front and rear panels, and an outer end panel connected to the other of the front and rear panels;

the outer end panel defining an outer edge;

a hang tab integrally extending from the outer edge of the outer end panel; the hang tab defining a hanger opening adapted to receive a portion of a hook to allow the container body to be supported by the hang tab;

the hang tab including first and second spaced legs that are connected to the outer edge of the outer end panel;

a locking tab extending from the outer edge of the outer end panel; the locking tab engaging the inner end panel to hold the outer end panel in the closed position;

wherein the locking tab is connected to the outer end panel between the first and second spaced legs;

wherein the locking tab includes a pair of lateral locking shoulders that engage the inner end panel when the outer end panel is in the closed position; and wherein the inner end panel defines an offset locking slot and wherein the offset locking slot includes end portions aligned with a fold line that defines the connection between the inner end panel and the one of front and rear panels; the end portions sized to receive the lateral locking shoulders of the locking tab.

14. The container of claim 13, wherein the outer end panel is in the shape of a vesica piscis.

15. The container of claim 14, wherein the front and rear panels are bowed outwardly to define a pillow pack.

16. The container of claim 15, wherein the front panel is directly connected to the rear panel at a fold line.

* * * * *